US006621401B1

(12) United States Patent
Kremers et al.

(10) Patent No.: US 6,621,401 B1
(45) Date of Patent: Sep. 16, 2003

(54) SELF-RECOVERING CURRENT LIMITING DEVICE HAVING LIQUID METAL

(75) Inventors: Wolfgang Kremers, Bonn (DE); Frank Berger, Swistal-Miel (DE); Thomas Freyermuth, Kalenborn (DE); Andreas Kraetzschmar, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/914,983

(22) PCT Filed: Feb. 24, 2000

(86) PCT No.: PCT/EP00/01512

§ 371 (c)(1),
(2), (4) Date: Jan. 24, 2002

(87) PCT Pub. No.: WO00/54298

PCT Pub. Date: Sep. 14, 2000

(30) Foreign Application Priority Data

Mar. 5, 1999 (DE) ..... 199 09 558

(51) Int. Cl.[7] ..... H01H 87/00; H01H 29/02

(52) U.S. Cl. ..... 337/21; 337/119; 337/121; 337/122; 337/167; 335/49; 335/50; 335/51; 335/57; 439/181

(58) Field of Search ..... 337/167, 21, 114, 337/119, 121, 122; 335/47, 49, 50, 51, 57; 200/32, 81.6, 152; 361/58; 439/88, 181; 29/622

(56) References Cited

U.S. PATENT DOCUMENTS

| | | | | | |
|---|---|---|---|---|---|
| 1,595,061 | A | * | 8/1926 | Valerius | 337/119 |
| 3,249,722 | A | * | 5/1966 | Lindberg, Jr. | 337/21 |
| 3,331,937 | A | * | 7/1967 | Harvey | 200/209 |
| 3,381,248 | A | * | 4/1968 | Furth | 335/51 |
| 3,389,359 | A | * | 6/1968 | Harris | 337/114 |
| 3,389,360 | A | * | 6/1968 | Keenan | 337/114 |
| 3,699,489 | A | * | 10/1972 | Imajyo | 337/21 |
| 3,838,373 | A | * | 9/1974 | Inoue et al. | 337/21 |
| 4,429,295 | A | * | 1/1984 | Wu | 337/119 |
| 4,510,356 | A | * | 4/1985 | Malm | 200/48 R |
| 5,471,185 | A | * | 11/1995 | Shea et al. | 335/51 |
| 5,581,192 | A | * | 12/1996 | Shea et al. | 324/722 |

FOREIGN PATENT DOCUMENTS

| | | | | |
|---|---|---|---|---|
| DE | 2652506 | | 5/1978 | |
| DE | 3132087 | A1 * | 8/1982 | H01H/29/00 |
| DE | 4012385 | | 3/1991 | |
| DE | 19903776 | A1 * | 8/2000 | H01H/87/00 |
| GB | 2036443 | A * | 6/1980 | H01H/1/06 |
| SU | 922911 | A | 4/1982 | |
| SU | 1076981 | | 2/1984 | |

* cited by examiner

*Primary Examiner*—Anatoly Vortman
(74) *Attorney, Agent, or Firm*—Davidson, Davidson & Kappel, LLC

(57) ABSTRACT

A self-recovering current-limiting device with a liquid metal includes two T-shaped electrodes for connection to an electric circuit to be protected. Each of the electrodes are made of a solid metal. Several compressor cavities which are partially filled with the liquid metal are situated one behind the other between the electrodes. The compressor cavities are formed by pressure-proof insulating bodies and by insulating intermediate walls which are provided with connecting channels and which are held by the insulating bodies. The insulating bodies and the intermediate walls form a uniform upper and lower half shell with opposite-lying joining surfaces. The half shells are connected in a sealed manner along joining surfaces in the area of a common middle plane of the connecting channels. Up to half of each of the electrodes is accommodated in corresponding recesses of the half shells, the electrodes extending with their respective middle limb out of the half shells.

18 Claims, 1 Drawing Sheet

SELF-RECOVERING CURRENT LIMITING DEVICE HAVING LIQUID METAL

BACKGROUND

The present invention relates to a self-recovering current-limiting device with liquid metal, including electrodes made of solid metal for the connection to an external electric circuit to be protected and several compression spaces which are partially filled with liquid metal.

RELATED ART

Soviet Union Patent Publication SU 922 911 A describes such a one-pole self-recovering current-limiting device containing two electrodes made of solid metal which are separated by first insulating bodies which are designed as a pressure-resistant insulating housing. Inside the insulating housing, compression spaces are formed by insulating intermediate walls and second insulating bodies which are arranged therebetween and designed as ring-shaped sealing disks, the compression spaces being partially filled with liquid metal and arranged one behind the other and interconnected via connecting channels of the intermediate walls, the connecting channels being filled with liquid metal and arranged off-center. Thus, in normal operation, a continuous, inner conductive connection exists between the electrodes via the liquid metal. In the current-limiting event, the liquid metal is displaced from the connecting channels as a result of the high current density. In this manner, the electrical connection of the electrodes via the liquid metal is interrupted, resulting in the limiting of the short-circuit current. Subsequent to clearing or eliminating the short circuit, the connecting channels refill with liquid metal whereupon the current-limiting device is operational again. The intermediates walls have to resist the pressure rise during the vaporization of liquid metal and are composed of high-quality ceramic material having a high temperature resistance as well as a high resistance to erosion with respect to the action of an electric arc. In German Patent Application DE 40 12 385 A1, a current-limiting device having only one compression space is described and vacuum, protective gas, or an insulating liquid are mentioned as the medium above the liquid level. According to Soviet Union Patent Publication SU 1 076 981 A, the connecting channels of adjacent intermediate walls are staggered relative to each other for improving the limiting characteristics. It is known from German Patent Application DE 26 52 506 A1 to use gallium alloys, in particular GaInSn alloys in contact devices.

The current-limiting devices according to the related art require considerable constructional outlay and complexity, namely with respect to the great number of parts and to the expensive materials to be used as well as the difficult processing thereof.

SUMMARY OF THE INVENTION

Therefore, an object of the present invention-is to provide-a-self-recovering current-limiting device having liquid metal, the device being relatively simple and inexpensive to construct.

The present invention provides a self-recovering current-limiting device including a liquid metal. The device includes a first and a second electrode for connection to an electric circuit to be protected, each of the first and second electrodes being made of a respective solid metal; a plurality of pressure-resistant insulating bodies; and a plurality of insulating intermediate walls supported by-the plurality of insulating bodies, the plurality of insulating intermediate walls and the plurality of pressure-resistant insulating bodies defining a plurality of first compression spaces, the plurality of insulating intermediate walls defining a plurality of connecting channels, the plurality of first compression spaces being disposed one behind the other between the first and second electrodes and being at least partially filled with the liquid metal. The plurality of insulating bodies and the plurality of intermediate walls define a upper half shell and a lower half shell, the upper half shell including a first joining surface and the lower half shell including a second joining surface opposing the first joining surface, the upper and lower half shells being sealingly joined in a region of a common middle plane of the plurality of connecting channels along the first and second joining surfaces. Moreover, the first and second electrodes are each substantially T-shaped, a respective half of each of the first and second electrodes being supported in respective corresponding recess in each of the upper and lower half shells, a respective middle leg of each of the first and second electrodes projecting respectively outward from the upper and lower half shells.

The half shells which are uniformly designed as insulating bodies and intermediate half walls, the sealing connection of the half shells and the bearing arrangement of the T-shaped electrodes give rise to a current-limiting device which is easy and quick to assemble with a few different parts featuring high functional integration, without resulting in disadvantages for the working properties. To produce a range of current-limiting devices having differently scaled rated current ranges is it sufficient to make available these few parts in a manner that their dimensions are correspondingly scaled. The current-limiting device is suitable for two positions of use which are basically rotated relative to each other by 180°. The frictional connection of the two half shells is effected by known device such as screw connections and/or clamping.

An even number of compression spaces between the electrodes appertaining to a pole, respectively, results in the advantage of designing both half shells identically, involving a further reduction in the number of parts.

An embodiment of the present invention provides a structural combination of several poles appertaining to an electric circuit, the seal along the joining surfaces of the half shells making the seal between the poles at the same time. As opposed to a plurality of single-pole current-limiting devices, a multipole current-limiting device of that kind takes a significantly smaller unit volume and requires less expenditure for assembly.

It is expedient to provide sealing material between the half shells. Proposed for this purpose are, in particular, sealing bodies which are to be advantageously inserted into hollow profiles provided in the joining surfaces for that purpose and/or a sealing layer which is to be applied to at least one of the joining surfaces, for example, by sticking.

A staggered arrangement of the connecting channels of adjacent intermediate walls results in the lengthening of the electric arc, thus increasing the current-limiting effect but can also suppress the formation of a long electric arc across all compression spaces and force the division into a plurality of effective, limiting partial electric arcs. GaInSn alloys as the liquid metal to be used are easy to handle because of their physiological harmlessness. An alloy of 660 parts by weight of gallium, 205 parts by weight of indium, and 135 parts by weight of tin is liquid from 10° C. to 2000° C. at normal pressure and possesses sufficient electrical conductivity.

In an embodiment of the present invention the half shells feature sleeves in the region of the connecting channels, the sleeves being made of high temperature and erosion resistant insulating material and the rest of the half shells being made of a material which, in comparison, has a lower quality such as cast ceramics. In this manner, the use of high-quality materials is effectively limited to the regions of the half shells which are exposed to the extreme conditions in the short-circuit event. Except for the sleeves, it is advantageous for the half shells to be made of an inexpensive molding material which, in whole, has to satisfy the pressure conditions arising in the limiting event and has to satisfy the low temperature requirements arising outside of the vicinity of the connecting channels.

In another embodiment of the present invention the half shells are made of a non-ceramic material which is resistant to temperature and erosion. In particular, mica is a material which is inexpensive and easy to process, for example using cutting machining techniques, and which has a sufficient resistance to high temperatures and to the action of an electric arc. The half shells can also be manufactured in an inexpensive manner, in particular in the case of great quantities, from a molding material which is resistant to high temperatures or from a glass-ceramics which is easy to mold and to process. In a method for equipping such a current-limiting device the electrodes and a number of connected and therefore easy-to-handle parts of the frozen liquid metal, which number corresponds to the designed number of poles, are inserted into the recesses of the lower half shell which are provided for this. A part which is frozen in such a manner is made of a number of ingots which corresponds to the number of compression spaces of the respective pole and a corresponding number of webs connecting the ingots one behind the other. The part is inserted with its ingots into the compression half spaces formed by the respective half shell, and with its webs into the half connecting channels formed by this half shell. Thereupon, the current-limiting device is completed by sealingly joining the two half shells. The height of the frozen ingots basically corresponds to the later filling level of the liquid metal which is molten at the service temperature. In this context, inlet openings in the insulating body for the liquid metal and outlet openings for gasses to be expelled are not required.

In a method for equipping the current-limiting device according to the present invention the liquid metal is inserted into the compression half spaces formed by the lower half shell in the form of frozen and therefore easy-to-handle unconnected ingots. Thereupon, the current-limiting device is completed by tightly joining the two half shells. The height of the frozen ingots is decisive for the later filling level of the molten liquid metal. Inlet and outlet openings in the insulating body are not required here either.

Subsequent to the above described equipping procedures, the two half shells are expediently to be connected under vacuum or a protective gas. In the so finished current-limiting device, the vacuum or the protective gas constitutes the medium above the liquid level.

DETAILED DESCRIPTION

Figure 1:
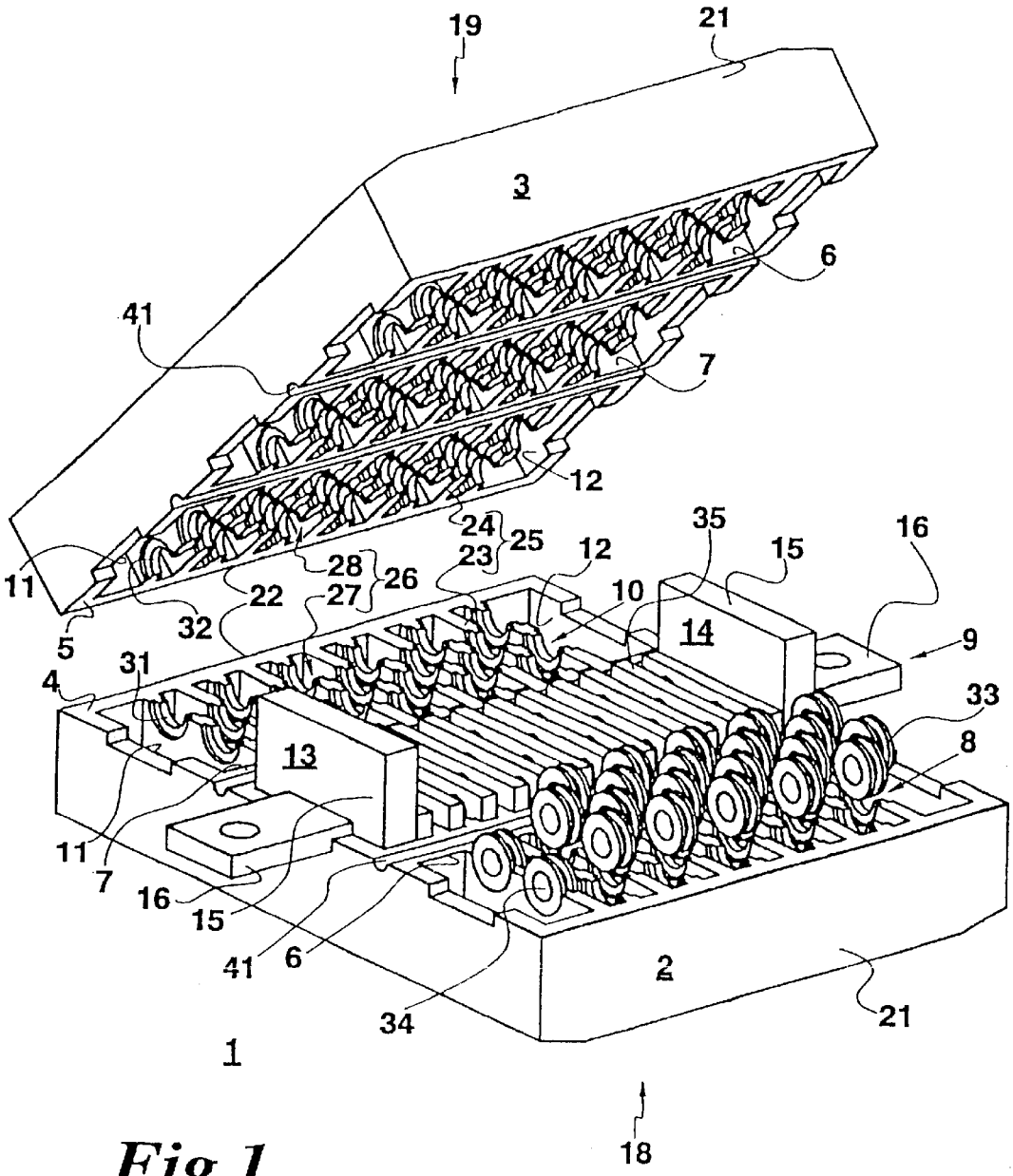
FIG. 1 shows a perspective partially disassembled view of a current-limiting device according to the present invention.

The outer casing of current-limiting device 1 is formed by an insulating body including two identical half shells 2 and 3 which are to be connected at their joining surfaces 4 and 5. Joining surfaces 4 and 5 run in the middle plane of ready-mounted current-limiting device 1. Half shells 2 and 3 are made of a molding material which can resist the pressure arising in the short-circuit event but which does not have to satisfy the high requirements of the conditions arising in the short-circuit event due to the high temperatures and the electric arcs developed. Half shells 2 and 3 each include two parallel running dividing walls 6 and 7 which run perpendicularly to joining surfaces 4 and 5 and electrically separate three poles 8, 9 and 10 running parallel side by side in the interior of the joined half shells. Each pole 8 through 10 is allocated two recesses 11 and 12 inside of half shells 2 and 3, respectively. Half of each of T-shaped electrodes 13 or 14 made of copper is accommodated in recesses 11 and 12 of lower half shell 2 (depicted in FIG. 1 only for middle pole 9). The other half of electrodes 13, 14 is received by corresponding recesses 11, 12 of upper half shell 3. Electrodes 13, 14 are each composed of a cuboidal transverse leg 15 and a middle leg 16 which perpendicularly projects therefrom and extends outward from joined half shells 2 and 3, in each case forming the connecting conductor for the external electric circuit to be protected. Transverse legs 15 extend perpendicularly to joining surfaces 4, 5 and to dividing half walls 6, 7. Middle legs 16 extend parallel to joining surfaces 4, 5 and in prolongation of poles 8, 9, 10.

In each half shell 2 and 3, an odd number of intermediate half walls 23 and 24 in each case extend in middle pole 9 between dividing half walls 6 and 7 which laterally border the middle pole as well as in pole 8 located on the right, between laterally bordering dividing wall 6 and half side wall 21 located opposite as well as in pole 10 located on the left, between laterally bordering dividing wall 7 and half side wall 22 located opposite. When joining half shells 2 and 3, intermediate half walls 23 and 24 produce intermediate walls 25 which extend from covering wall 18, which is located at the bottom, of lower half shell 2 to covering wall 19, which is located at the top, of upper half shell 3. In each pole 8, 9, 10, a row of compression spaces 26 arranged one behind the other is in each case formed by electrode 13 and 14, respectively, and the respective adjacent intermediate wall 25, as well as, in each case by two adjacent intermediate walls 25, each of the compression spaces being composed of a lower compression half space 27 located in lower half shell 2 and an upper compression half space 28 located in upper half shell 3. Each half shell 2 or 3, including intermediate half walls 23 or 24 is formed in one piece.

In the example, intermediate halfwalls 23 and 24 each have two semicircular, stepped openings 31 and 32, respectively, which are open in the plane of the respective joining surface 4 or 5. Appropriately formed sleeves 33 made of non-conducting material are to be inserted in openings 31 of lower half shell 2 (depicted in FIG. 1 in the inserted condition only in middle pole 9 and in the front intermediate half wall 23 of pole 8 located on the right; as for the remaining part of pole 8 only indicated in projection above appertaining openings 31). When joining half shells 2 and 3, the sleeves are embraced in the same way by corresponding openings 32 of intermediate half walls 24 of upper half shell 3. Sleeves 33 feature a central through-hole as a result of which connecting channels 34 exist between two adjacent compression spaces 26, respectively. As opposed to half shells 2 and 3, sleeves 33 are composed of a high temperature resistant ceramic material which satisfies the extreme requirements against influences of an electric arc in the short-circuit event. To enhance the limiting characteristics of current-limiting device 1, sleeves 33 of adjacent intermediate walls 25 are staggered relative to each other. The middle plane of current-limiting device 1 forms the common middle plane of all connecting channels 34 at the same time, and runs between joining surfaces 4 and 5.

Inserted into compression half spaces 27 of lower half shell 2 which has been equipped to this extent are ingots 35 of frozen liquid metal (depicted in FIG. 1 only for middle pole 9). Ingots 35 are retained flush by intermediate half walls 23 and dividing half walls 6 or side walls 21, 22, respectively. Ingots 35 project above the plane of joining surface 4 so far that the melting liquid metal fills up connecting channels 34 subsequent to the assembly of current-limiting device 1, and exceeds the connecting channels by a sufficient distance. If the joining of half shells 2 and 3 is carried out under a protective gas atmosphere, this protective gas then constitutes the medium above the liquid level.

Recessed in dividing halfwalls 6 and 7 are grooves 41 which are open toward the joining surfaces and into which insulating sealing bodies (not shown in FIG. 1) are to be inserted. A sealing layer (not shown in FIG. 1 either) is stuck onto joining surface 4 and/or 5. These materials guarantee the mutual sealing of poles 8 through 10 among themselves as well as the sealing of current-limiting device 1 altogether from the outside. Half shells 2 and 3 are to be joined in a force locking manner, for example, via clamping jaws which can be screwed together (for reasons of clarity not shown in FIG. 1). The odd number of intermediate half walls 23 and 24, respectively, results in an even number of compression half spaces 27 and 28, respectively, which, in turn, allows the two half shells 2 and 3 to be designed identically. Consequently, for manufacturing the described three-pole embodiment of current-limiting device 1, except for the just mentioned sealing and connecting device, only 4 different parts are needed, namely identical half shells 2 and 3, identical electrodes 13 and 14, identical sleeves 33, and identical ingots 35. Current-limiting device I can be operated in two positions of use, the second position of use resulting from the first position of use by a rotation by 180° about the longitudinal axis running through middle pole 9.

The present invention is not limited to the above described specific embodiments but also includes all equally acting embodiments along the lines of the present invention. Thus, half shells 2 and 3 can also be joined without liquid metal previously solidified in ingots; in this case, however, provision is to be made for closable filling ports for the liquid metal to be filled in later and, if required, closable outlet ports for issuing gas. If the half shells are wholy composed of a temperature and erosion resistant material, the connecting channels can be formed in halves directly by the intermediate half walls, allowing connected, frozen parts of liquid metal to be inserted per pole during assembly. The current-limiting device according to the present invention can of course also be designed to have more or less than three poles.

What is claimed is:

1. A self-recovering current-limiting device with liquid metal, the device comprising:

a first and a second electrode for connection to an electric circuit to be protected, each of the first and second electrodes being made of a respective solid metal;

a plurality of pressure-resistant insulating bodies;

a plurality of insulating intermediate walls supported by the plurality of insulating bodies, the plurality of insulating intermediate walls and the plurality of pressure-resistant insulating bodies defining a plurality of first compression spaces, the plurality of insulating intermediate walls defining a plurality of connecting channels, the plurality of first compression spaces being disposed one behind the other between the first and second electrodes and being at least partially filled with the liquid metal;

wherein the plurality of insulating bodies and the plurality of intermediate walls define a upper half shell and a lower half shell, the upper half shell including a first joining surface and the lower half shell including a second joining surface opposing the first joining surface, the upper and lower half shells being sealingly joined in a region of a common middle plane of the plurality of connecting channels along the first and second joining surfaces; and wherein the first and second electrodes are each substantially T-shaped, a respective half of each of the first and second electrodes being supported in respective corresponding recess in each of the upper and lower half shells, a respective middle leg of each of the first and second electrodes projecting respectively outward from the upper and lower half shells.

2. The self-recovering current-limiting device as recited in claim 1 wherein the plurality of first compression spaces includes an even number of compression spaces and wherein the upper and lower half shells have a same shape.

3. The self-recovering current-limiting device as recited in claim 1 wherein:

the first and second electrodes are associated with a first pole of the device and further comprising a second and a third electrode associated with a second pole of the device and a fifth and sixth electrode associated with a third pole of the device, the first, second and third poles being disposed side-by-side and parallel to the common middle plane of the plurality of connecting channels;

a plurality of second compression spaces disposed one behind the other are defined between the third and a fourth electrodes;

a plurality of third compression spaces disposed one behind the other are defined between the fifth and sixth electrodes; and the upper and lower half shells further include a first insulating dividing half wall and a second insulating dividing half wall, the first insulating dividing half wall being disposed between the plurality of first compression spaces and the plurality of second compression spaces, the second insulating dividing half wall being disposed between the plurality of first compression spaces and the plurality of third compression spaces.

4. The self-recovering current-limiting device as recited in claim 1 further comprising an electrically insulating sealing material disposed between the first and second joining surfaces of the upper and lower half shells.

5. The self-recovering current-limiting device as recited in claim 4 wherein the sealing material includes at least one sealing body.

6. The self-recovering current-limiting device as recited in claim 4 wherein the sealing material includes a sealing layer applied to at least one of the first and second joining surfaces.

7. The self-recovering current-limiting device as recited in claim 1 wherein the connecting channels defined by adjacent ones of the intermediate walls are staggered relative to each other.

8. The self-recovering current-limiting device as recited in claim 1 wherein the liquid metal includes an alloy of GaInSn.

9. The self-recovering current-limiting device as recited in claim 1 further comprising a plurality of sleeves disposed between the upper and lower half shells and held by the upper and lower half shells in respective regions of the connecting channels, the sleeves including a high temperature and erosion resistant material, the upper and lower half shells including a material having a lower quality than the high temperature and erosion resistant material.

10. The self-recovering current-limiting device as recited in claim 1 wherein the upper and lower half shells include at least one of a temperature and erosion resistant nonceramic material, a high temperature resistant molding material, a processable glass-ceramic material, and a cast ceramic material.

11. The self-recovering current-limiting device as recited in claim 10 wherein the temperature and erosion resistant non-ceramic material includes mica.

12. A method for making a self-recovering current-limiting device, the self-recovering current-limiting device including:

a first and a second electrode for connection to an electric circuit to be protected, each of the first and second electrodes being made of a respective solid metal;

a plurality of pressure-resistant insulating bodies;

a plurality of insulating intermediate walls supported by the plurality of insulating bodies, the plurality of insulating intermediate walls and the plurality of pressure-resistant insulating bodies defining a plurality of first compression spaces, the plurality of insulating intermediate walls defining a plurality of connecting channels, the plurality of first compression spaces being disposed one behind the other between the first and second electrodes and being at least partially filled with the liquid metal;

wherein the plurality of insulating bodies and the plurality of intermediate walls define a upper half shell and a lower half shell, the upper half shell including a first joining surface and the lower half shell including a second joining surface opposing the first joining surface, the upper and lower half shells being sealingly joined in a region of a common middle plane of the plurality of connecting channels along the first and second joining surfaces, the upper and lower half shells including at least one of a temperature and erosion resistant non-ceramic material, a high temperature resistant molding material, a processable glass-ceramic material, and a cast ceramic material; and wherein the first and second electrodes are each substantially T-shaped, a respective half of each of the first and second electrodes being supported in respective corresponding recess in each of the upper and lower half shells, a respective middle leg of each of the first and second electrodes projecting respectively outward from the upper and lower half shells; the method comprising:

disposing a frozen body of the liquid metal in the upper or lower half shell, the frozen body including a plurality of ingots connected by webs, the frozen body being disposed so that the ingots are disposed in portions of the plurality of first compression spaces defined by the respective upper or lower half shell with the webs connect the ingots via respective portions of the plurality of connecting channels; and joining the upper and lower half shells.

13. The method as recited in claim 12 wherein the temperature and erosion resistant non-ceramic material includes mica.

14. The method as recited in claim 13 wherein the joining of the upper and lower half shells is performed so as to seal the upper and lower half shells and the joining is performed under at least one of a vacuum and a protective gas.

15. A method for making a self-recovering current-limiting device, the self-recovering current-limiting device including:

a first and a second electrode for connection to an electric circuit to be protected, each of the first and second electrodes being made of a respective solid metal;

a plurality of pressure-resistant insulating bodies;

a plurality of insulating intermediate walls supported by the plurality of insulating bodies, the plurality of insulating intermediate walls and the plurality of pressure-resistant insulating bodies defining a plurality of first compression spaces, the plurality of insulating intermediate walls defining a plurality of connecting channels, the plurality of first compression spaces being disposed one behind the other between the first and second electrodes and being at least partially filled with the liquid metal;

wherein the plurality of insulating bodies and the plurality of intermediate walls define a upper half shell and a lower half shell, the upper half shell including a first joining surface and the lower half shell including a second joining surface opposing the first joining surface, the upper and lower half shells being sealingly joined in a region of a common middle plane of the plurality of connecting channels along the first and second joining surfaces; and wherein the first and second electrodes are each substantially T-shaped, a respective half of each of the first and second electrodes being supported in respective corresponding recess in each of the upper and lower half shells, a respective middle leg of each of the first and second electrodes projecting respectively outward from the upper and lower half shells; the method comprising:

disposing a plurality of ingots of the liquid metal in portions of the plurality of first compression spaces defined by the respective upper or lower half shell, liquid metal being frozen; and joining the upper and lower half shells.

16. The self-recovering current-limiting device as recited in claim 15 wherein the upper and lower half shells include at least one of a temperature and erosion resistant non-ceramic material, a high temperature resistant molding material, a processable glass-ceramic material, and a cast ceramic material.

17. The self-recovering current-limiting device as recited in claim 16 wherein the temperature and erosion resistant non-ceramic material includes mica.

18. The method as recited in claim 15 wherein the joining of the upper and lower half shells is performed so as to seal the upper and lower half shells and the joining is performed under at least lone of a vacuum and a protective gas.

* * * * *